US011393669B2

(12) United States Patent
Matsushita

(10) Patent No.: US 11,393,669 B2
(45) Date of Patent: Jul. 19, 2022

(54) MASS SPECTROMETER

(71) Applicant: SHIMADZU CORPORATION, Kyoto (JP)

(72) Inventor: Tomoyoshi Matsushita, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/596,329

(22) Filed: Oct. 8, 2019

(65) Prior Publication Data

US 2020/0185210 A1 Jun. 11, 2020

(30) Foreign Application Priority Data

Dec. 5, 2018 (JP) ..... JP2018-227790

(51) Int. Cl.
*H01J 49/06* (2006.01)
*H01J 49/10* (2006.01)
(Continued)

(52) U.S. Cl.
CPC ..... *H01J 49/105* (2013.01); *H01J 49/0063* (2013.01); *H01J 49/068* (2013.01); *H01J 49/4215* (2013.01); *H01J 49/0031* (2013.01)

(58) Field of Classification Search
CPC .. H01J 49/105; H01J 49/4215; H01J 49/0062; H01J 49/068; H01J 49/0031; H01J 49/005; H01J 49/061; H01J 49/067
See application file for complete search history.

(56) References Cited

U.S. PATENT DOCUMENTS 5,514,868 A * 5/1996 Dixon ..... H01J 49/482 250/288
5,633,496 A * 5/1997 Sakairi ..... H01J 49/067 250/281

(Continued)

FOREIGN PATENT DOCUMENTS

JP 5281223 B2 9/2013
JP 2017-535040 A 11/2017

(Continued)

OTHER PUBLICATIONS

Notice of Reasons for Refusal dated Mar. 29, 2022 from the Japanese Patent Office in JP Application Machine No. 2018-227790.

*Primary Examiner* — Wyatt A Stoffa
(74) *Attorney, Agent, or Firm* — Sughrue Mion, PLLC

(57) ABSTRACT

A mass spectrometer includes: an ion source; a collision cell into which a predetermined gas is introduced, for allowing an ion generated in the ion source to be in contact with the predetermined gas; and a quadruple mass filter for performing mass spectrometry on the ion ejected from the collision cell. The mass spectrometer further includes: an inlet electrode provided at an ion injection port through which the ion is incident in the collision cell; a voltage generator for applying a direct-current voltage to the inlet electrode; and a voltage controller and a controller for controlling the voltage generator to apply, to the inlet electrode, a direct-current voltage with a polarity same as a polarity of an unnecessary ion generated in the ion source, during at least a part of a standby period of time in which no analysis-target ion is analyzed.

8 Claims, 5 Drawing Sheets

(51) Int. Cl.
*H01J 49/42* (2006.01)
*H01J 49/00* (2006.01)

(56) References Cited

U.S. PATENT DOCUMENTS 6,924,478 B1 * 8/2005 Zubarev ..... H01J 49/0054 250/296
8,309,914 B2 * 11/2012 Guna ..... H01J 49/005 250/281
10,984,998 B2 * 4/2021 Midorikawa ..... H01J 49/022
11,241,166 B1 * 2/2022 Lee ..... A61B 5/0024
2011/0006203 A1 1/2011 Fujita et al.
2012/0160998 A1 * 6/2012 Kou ..... H01J 49/4215 250/288
2013/0240726 A1 * 9/2013 Hasegawa ..... H01J 49/063 250/281
2014/0001352 A1 * 1/2014 Franzke ..... H01J 49/10 250/282
2014/0224983 A1 * 8/2014 Chingin ..... H01J 49/0095 250/288
2014/0252219 A1 * 9/2014 Rafferty ..... H01J 49/424 250/282
2016/0233064 A1 * 8/2016 Campbell ..... H01J 49/0031
2017/0032953 A1 * 2/2017 Guna ..... H01J 49/4205
2017/0098535 A1 * 4/2017 Ramsey ..... H01J 49/167
2017/0178885 A1 * 6/2017 Welkie ..... H01J 49/0045
2019/0287781 A1 * 9/2019 Ramsey ..... H01J 49/0031
2020/0035477 A1 * 1/2020 Welkie ..... H01J 49/062
2020/0152441 A1 * 5/2020 Furuhashi ..... H01J 49/063

FOREIGN PATENT DOCUMENTS

WO 02/019382 A2 3/2002
WO 2009/095958 A1 8/2009
WO 2016/073306 A1 5/2016

* cited by examiner

MASS SPECTROMETER

TECHNICAL FIELD

The present invention relates to a mass spectrometer, and specifically to a mass spectrometer including a collision cell for allowing a predetermined gas to be in contact with ions originating from a sample component.

BACKGROUND ART

An inductively coupled plasma (hereinafter, referred to as "ICP") mass spectrometer (hereinafter, referred to as "ICP-MS") using, as an ion source, the ICP ion source is often used for analyzing a plurality of metals individually contained in minimal amounts in a sample liquid at one time.

In a typical ICP-MS, ions that originate from a sample component and are generated in the ICP ion source in an approximately atmospheric pressure environment are taken into a chamber maintained at vacuum atmosphere through an ion take-in port, such as a sampling cone and a skimmer. The taken ions are accelerated by an electric field formed by an extraction electrode, and introduced into a collision cell through a converging lens. Into the chamber, interference ions generated due to various factors are also taken in addition to ions of an observation-target component (element). The interference ions include: ions originating from the gas, argon for example, used for creating the plasma in the ICP ion source; ions originating from impurities contained in a sample liquid; ions originating from additives (nitric acid or hydrochloric acid, for example) added to the sample liquid; and so on. The collision cell is used for separating such interference ions from target ions.

During the analysis, helium (He) gas (or another inert gas) is introduced into the collision cell. Ions injected into the collision cell frequently come in contact with the He gas in the collision cell, and at every contact, the kinetic energy of each of the ions is reduced. An interference ion is usually a polyatomic ion having a collision cross-section larger than that of an ion to be observed having the same mass which is usually an element ion. Accordingly, interference ions come in contact with the He gas more frequently than the ions to be observed do, and thus the kinetic energy of the interference ions decreases more in the collision cell. In view of this situation, by forming a potential barrier at an ejection port of the collision cell, ions having the kinetic energy larger than or equal to a predetermined value are allowed to pass, and ions having the kinetic energy smaller than the predetermined value are blocked, thereby the interference ions are separated and removed from the ions to be observed. Such methods of separating and removing ions, using the aforementioned processes, are referred to as the kinetic energy discrimination (KED) method.

Sometimes the charge transfer reaction or the like is used for separating, in the collision cell, the observation-target ions from the interference ions having the same mass. In this case, an active reaction gas, such as hydrogen or ammonia, is introduced in the collision cell, instead of the inert gas. Certain kinds of interference ions which are incident in the collision cell come in contact with the reaction gas, and cause reactions including the electron transfer and proton shift, turning to neutral particles, or to other ions having another mass-to-charge ratio. The neutral particles are not trapped by a radio-frequency electric field formed by an ion guide in the collision cell, and thus are diffused. Further, ions derived from the interference ions having altered mass-to-charge ratio are separated from the observation-target ions in a mass separator, such as a later-stage quadrupole mass filter. Accordingly, the interference ions can be separated and removed from the observation-target ions.

When a reaction gas is used, the collision cell is sometimes referred to as a reaction cell. However, the term "collision cell" is consistently used throughout the present disclosure.

Although the removal of the interference ions by the collision cell having the aforementioned configuration is widely utilized in the ICP-MS, the following problems are induced.

In the typical ICP-MS, an ion optical system is arranged on an approximately straight-line axis that extends from a sampling cone, which is the ion port between the ICP ion source and a vacuum region, to the collision cell. Accordingly, in addition to ions of a plasma gas, e.g., Ar, which are generated in the ICP ion source, reactive neutral particles (radical particles) and molecules originating from Ar and the like are taken into the chamber with a gas flow from the sampling cone. When incident in the collision cell, the Ar ions ($Ar^+$, $Ar_2^+$) are trapped by the radio-frequency electric field formed by the ion guide disposed inside the collision cell. When the reactive neutral particles of Ar are incident in the collision cell, and come in contact with the collision gas or the reaction gas, the particles are easily ionized. As such, the Ar ions generated in the collision cell are trapped by the radio-frequency electric field.

The majority of Ar ions trapped in the collision cell as mentioned earlier, cannot overcome the energy barrier for blocking the interference ions, which is formed at the ejection port of the collision cell. Thus, such undesired ions are hardly discharged from the collision cell, and stay in the collision cell. If such a stay of the undesired ions in the collision cell occurs immediately before the start of the analysis, the trajectories and kinetic energy of the target element ions to be analyzed are affected by a space charge effect of the staying ions. As a result, the ion intensity observed by the detector is unstable, so that drift remains for an extended period of time.

In contrast, in the ICP-MS disclosed in Patent Literature 1, an off-axis optical system or a deflected-axis optical system is arranged in front of the collision cell. In the off-axis optical system, the central axis of the ion take-in port between the ICP ion source and the vacuum region and the central axis of the collision cell are displaced each other from a straight line. The reactive neutral particles and molecules, both of which do not have electric charge, incident in the vacuum region through the ion take-in port, straightly move in the off-axis optical system, and do not reach the inlet of the collision cell. Thus, the reactive neutral particles and molecules originating from Ar or other gases do not enter the collision cell, thereby the stay of undesired ions in the collision cell is reduced.

CITATION LIST

Patent Literature

Patent Literature 1: WO 2002/019382 A

SUMMARY OF INVENTION

Technical Problem

However, Ar ions generated in the ICP ion source cannot be removed with the off-axis optical system. Furthermore, in the off-axis optical system, target-element ions are attracted by an electric field and guided to the inlet of the collision cell. In this case, the transportation efficiency of the target-element ions is inevitably low in comparison with the case where the axes are on a straight line. This may decrease the detection sensitivity of the target-element ions.

The present invention has been made to solve the previously described problems. An object of the present invention is to provide a mass spectrometer capable of performing highly accurate analysis by eliminating instability in the intensity of the observation-target ions due to the space charge effect caused by the accumulation of unnecessary ions in the collision cell and introducing less drift of the ion intensity.

Solution to Problem

A mass spectrometer according to the first aspect of the present invention is the mass spectrometer including: an ion source configured to ionize a sample component; a cell into which a predetermined gas is introduced, and configured to allow an ion generated in the ion source or an ion originating from the ion generated in the ion source to be in contact with the predetermined gas; and a mass spectrometer unit configured to perform mass spectrometry on an ion ejected from the cell or an ion originating from the ion ejected from the cell. The mass spectrometer further includes:

an inlet electrode provided at an ion injection port through which the ion is incident in the cell;

a voltage generator configured to apply a direct-current voltage to the inlet electrode; and a controller configured to control the voltage generator to apply, to the inlet electrode, a direct-current voltage with a polarity the same as a polarity of an elimination-target ion generated in the ion source, during at least a part of a standby period of time in which no analysis-target ion is analyzed.

A mass spectrometer according to the second aspect of the present invention is the mass spectrometer including: an ion source configured to ionize a sample component; a cell into which a predetermined gas is introduced, and which allows an ion generated in the ion source or an ion originating from the ion generated in the ion source to be in contact with the predetermined gas; and a mass spectrometer unit that performs mass spectrometry on the ion ejected from the cell or an ion originating from the ion ejected from the cell. The mass spectrometer further includes:

a skimmer that is provided between the ion source and the cell, and has, at its top, an ion passing port;

an attraction electrode that is provided between the skimmer and the cell, and configured to promote attraction of the ion through the ion passing port of the skimmer, using an effect of an electric field;

a voltage generator configured to apply a direct-current voltage to the attraction electrode; and a controller configured to control the voltage generator to apply, to the attraction electrode, a direct-current voltage with a polarity the same as a polarity of an elimination-target ion generated in the ion source, or a direct-current voltage having no effect of attracting the elimination-target ion, during at least a part of a standby period of time in which no analysis-target ion is analyzed.

Advantageous Effects of Invention

In the mass spectrometer according to the first and second aspects of the present invention, unnecessary ions (elimination-target ions) generated in an ion source hardly enter the cell. With this configuration, the space charge effect caused by the accumulation of the unnecessary ions in the cell, such as a collision cell, is lowered or almost prevented, thereby the influence on the observation-target ions introduced in the cell during the analysis is reduced or eliminated. As a result, a drift or other undesirable influence on the ion intensity can be reduced, thereby a precise analysis is enabled.

In particular, in the mass spectrometer according to the second aspect of the present invention, unnecessary reactive neutral particles or other neutral particles generated in the ion source, as well as the unnecessary ions, hardly reach the cell either. With this configuration, fewer unnecessary ions are generated due to contact of the reactive neutral particles with gas molecules in the cell. Therefore, the configuration is more advantageous for lowering the space charge effect in the cell.

DESCRIPTION OF EMBODIMENTS

The ICM-MS according to an embodiment of the present invention is described, with reference to the drawings.

<Configuration of Apparatus According to Present Embodiment>

Figure 1:
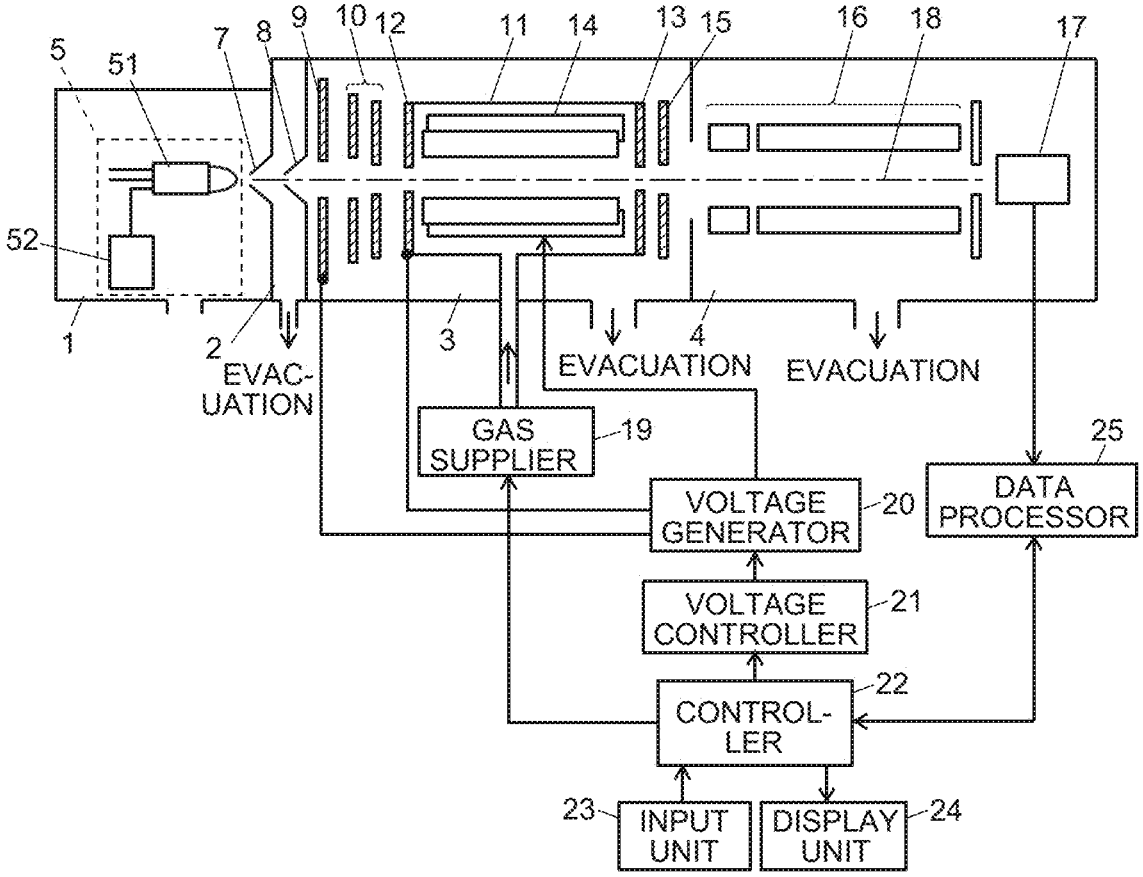
FIG. 1 is a schematic configuration diagram of the ICP-MS according to an embodiment of the present invention.

FIG. 1 is a schematic configuration diagram of the ICP-MS according to the present embodiment.

The ICP-MS includes an ionization chamber 1 maintained at atmospheric pressure and electrically grounded, a first vacuum chamber 2, a second vacuum chamber 3, and a third vacuum chamber 4. The degree of vacuum increases from the ionization chamber 1 toward the first to third vacuum chambers 1, 2, and 3, in this order. Although not shown, the interior of the first vacuum chamber 2 is evacuated by a rotary pump, and the interiors of the second vacuum chamber 3 and the third vacuum chamber 4 are evacuated by a rotary pump and a turbo-molecular pump.

The ionization chamber 1 contains, in its interior, an ICP ion source 5. The ICP ion source 5 includes a plasma torch 51 that has a sample tube through which a liquid sample atomized by a nebulizer gas flows, a plasma gas tube formed on the outer periphery of the sample tube, and a cooled gas tube formed on the outer periphery of the plasma gas tube. At the inlet end of the sample tube of the plasma torch 51, an autosampler 52 for introducing the liquid sample into the plasma torch 51 is provided. Furthermore, although not shown, the sample tube is connected by a nebulizer gas supply source that supplies the nebulizer gas, a plasma gas supply source that supplies a plasma gas (for example, an Ar gas), and a cooled gas supply source that supplies a cooled gas. It should be noted that this configuration of the ICP ion source 5 is a standard configuration, and thus can be modified in various manners.

The first vacuum chamber 2 is formed between a sampling cone 7 having an approximately conical shape, and a skimmer 8 also having the approximately conical shape like the sampling cone. The sampling cone 7 and the skimmer 8 each have an ion passing port at their respective tops. The first vacuum chamber 2 functions as an interface for sending ions supplied from the ICP ion source 5 to the later stage, and for discharging a solvent gas or the like.

Inside the second vacuum chamber 3, an attraction electrode 9, an ion lens 10 for converging ions, a collision cell 11, and an energy barrier forming electrode 15 are located in this order from the side close to the skimmer 8, i.e., the side from which ions are incident. The attraction electrode 9, the ion lens 10, and the energy barrier forming electrode 15 each are a disc-shaped electrode in which an approximately circular opening for allowing ions to pass through is formed. An inlet electrode 12 provided with an ion passing opening 121 is located in the inlet side of the collision cell 11, and an outlet electrode 13 provided with an ion passing opening 131 in the similar way as the inlet electrode 12 is located in the outlet side of the collision cell 11. Inside the collision cell 11, a multipole (for example, octpole) ion guide 14 including a plurality of rod electrodes provided in parallel to an ion optical axis 18 is provided.

Inside the third vacuum chamber 4 that is the last stage, a quadrupole mass filter 16 including a pre-rod electrode and a main rod electrode, and an ion detector 17 are located.

A gas supplier 19 supplies a collision gas or a reaction gas to the interior of the collision cell 11 through the gas supplying tube. The collision gas is He (or other inert gas), and the reaction gas is hydrogen, ammonia, or the like. A voltage generator 20 generates voltage to be applied to each of the sections. In FIG. 1, only a voltage supply line that is particularly important in the apparatus according to the present embodiment is illustrated for preventing the drawing from being complicated. The voltage generator 20 includes a plurality of direct-current voltage generators that generate direct-current voltages at the predetermined voltage, and a plurality of radio-frequency voltage generators that generate radio-frequency voltages with the predetermined amplitude and the predetermined frequency.

The voltage controller 21 controls the magnitude of the voltage to be applied from the voltage generator 20 to each of the sections and the timing of the application. The controller 22 totally controls the respective sections, so as to perform the analysis, and has the function as a user interface via an input unit 23 and a display unit 24. The data processor 25 includes an analog-digital (AD) convertor that digitizes detection signals obtained in the ion detector 17, and performs processing, such as processing on the collected data for creating a mass spectrum.

The controller 22, the voltage controller 21, and the data processor 25 are in fact a personal computer including a CPU, a RAM, an external storage, and other components. The predetermined programs previously installed in the computer are executed by the CPU and other sections, to embody functions of each of the sections.

<Operation of Apparatus According to Present Embodiment>

Figure 2:
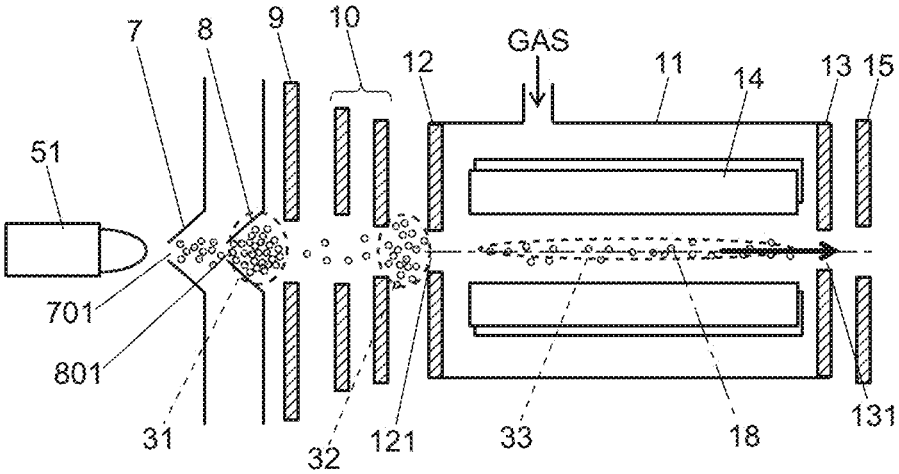
FIG. 2 is an explanatory diagram of the behavior of ions during an analysis-standby period of time in the ICP-MS according to the present embodiment.
Figure 3:
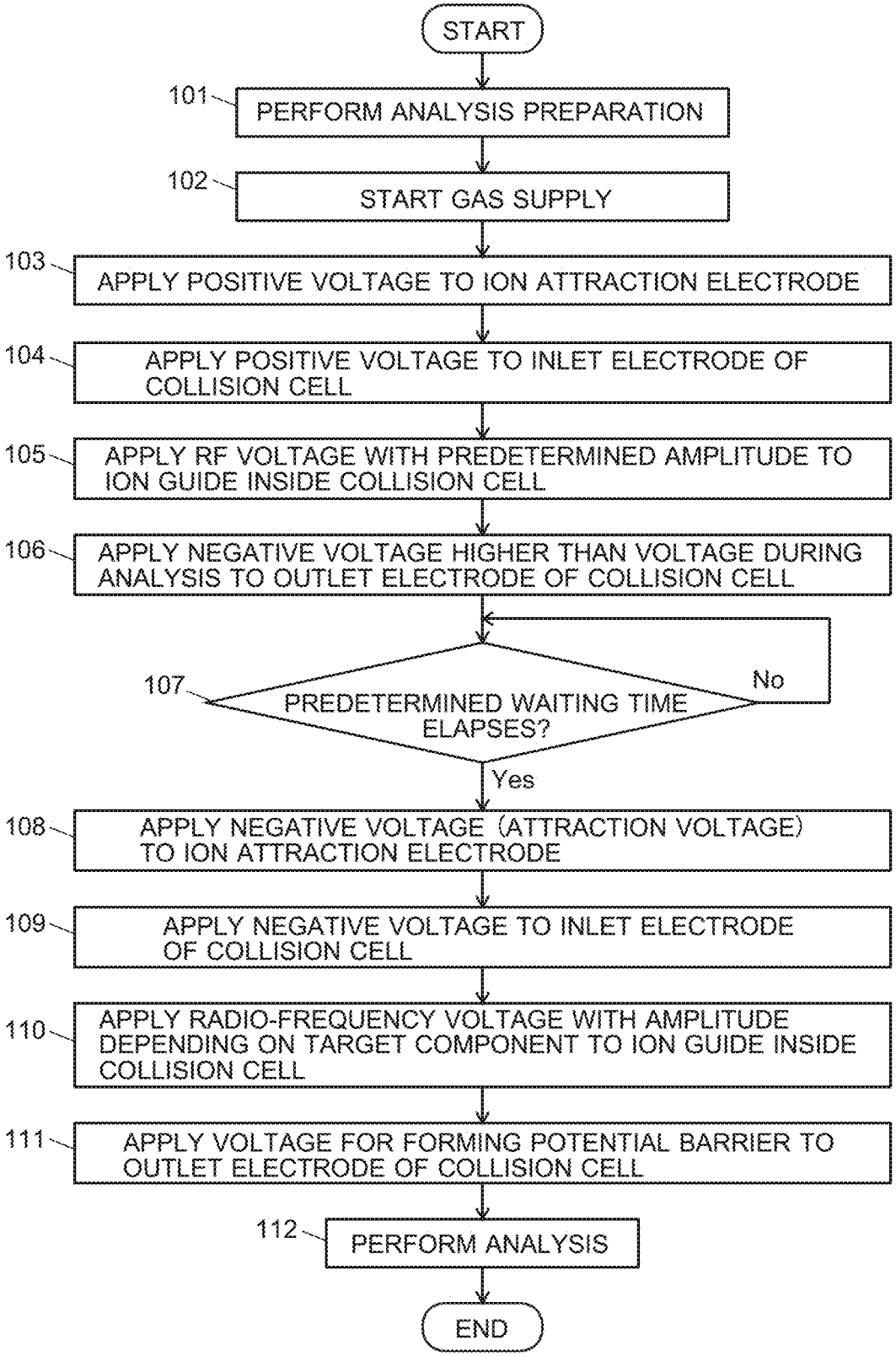
FIG. 3 is a control flowchart at the start of the analysis in the ICP-MS according to the present embodiment.

An analysis operation unique to the ICP-MS according to the present embodiment is described, with reference to FIGS. 2 and 3.

FIG. 3 is a control flowchart when a single sample is analyzed. Meanwhile, FIG. 2 is a schematic diagram for describing the behavior of ions during preparation of the analysis. Various element ions to be analyzed in the IPC-MS are usually cations. Thus, the description here is based on the presumption that the analysis-target ions are the cations. Here, even if the analysis-target ion is an anion, it is clear that the identical analysis as that of the following description can be performed by appropriately changing factors, such as the polarity of the voltage to be applied to each of the sections.

In a standby state before starting the analysis, each of the vacuum chambers 2, 3, and 4 is in the evacuated state. When a command of starting the analysis is issued by a user through the input unit 23, or a command of starting the analysis is automatically issued in accordance with an automatic analysis program previously set, the controller 22 starts the analysis preparation operation (Step 101). First, the controller 22 controls the gas supplier 19 to start continuously or intermittently supplying a predetermined gas into the collision cell 11 (Step 102). The types of supplied gas are varied depending on the analysis mode. The supplied gas is He gas, for example, in the collision mode, and hydrogen (H) gas, for example, in the reaction mode.

Even if the supply of a gas into the collision cell 11 is started, it takes a short period of time for filling the interior of the collision cell 11 with the gas. No substantial analysis can be performed until the interior of the collision cell is filled. Such a period of time corresponds to an analysis preparation term. The voltage controller 21 that has received the command from the controller 22 controls the voltage generator 20 to apply a positive direct-current voltage with the predetermined voltage value to the attraction electrode 9 so that a barrier of the potential higher than the initial energy of undesired ions generated in the ICP ion source 5 is formed between the skimmer 8 and the attraction electrode 9 (Step 103). The undesired ions here, which are generated in the ICP ion source 5, mainly originate from a plasma gas used in the ICP ion source 5. Accordingly, if the plasma gas is Ar, the undesired ions are $Ar^+$, $Ar_2^+$, and so on. The initial energy of the undesired ions is rather small. Thus, the voltage to be applied to the attraction electrode 9 is generally the positive voltage at a level of a few volts.

The voltage controller 21 controls the voltage generator 20 to apply the positive direct-current voltage with the predetermined voltage value to the inlet electrode 12 of the collision cell 11, under the command of the controller 22 (Step 104). At this time, the voltage applied to the inlet electrode 12 is, for example, the positive voltage at a level of several tens to 200V.

In addition, the voltage controller 21 controls the voltage generator 20 to apply a radio-frequency voltage with the amplitude value higher than those for the usual analysis to the ion guide 14 in the collision cell 11, under the command of the controller 22 (Step 105). Furthermore, the voltage controller 21 controls the voltage generator 20 to apply in a continuous manner or a pulsed manner the negative direct-current voltage with the predetermined voltage value higher than those for the usual analysis to the outlet electrode 13 of the collision cell 11 (Step 106). At this time, the amplitude value of the radio-frequency voltage applied to the ion guide 14 is, for example, 50V or more, the direct-current voltage applied to the outlet electrode 13 is, for example, the negative voltage at a level of −100V (−10 to—several tens V at the usual analysis).

As mentioned earlier, the direct-current voltage applied to the attraction electrode 9 causes an electric field having a polarity the same as that of the ions to be formed, so as to form a potential barrier in the vicinity of the attraction electrode 9. Ions that originate from the plasma gas or other gases are generated in the ICP ion source 5, and are incident in the second vacuum chamber 3 through the ion passing port 701 of the sampling cone 7 and the ion passing port 801 of the skimmer 8. Such ions are dammed by the aforementioned potential barrier. This causes the ions to stay in a region 31 between the skimmer 8 and the attraction electrode 9, increasing the density of the ions in the region 31. Not only the ions mentioned earlier but also reactive neutral particles and molecules of the plasma gas attempt to enter the vacuum region from the IPC ion source 5. However, the density of the ions in the region 31 between the skimmer 8 and the attraction electrode 9 is high, and thus the reactive neutral particles and the gas molecules, which have passed through the ion passing port 801 of the skimmer 8, are easily in contact with the ions. The reactive neutral particles and gas molecules in contact with the ions are changed in their trajectories, so as to collide with the electrode or others around the region 31 to disappear or to be discharged from the interior of the second vacuum chamber 3 to the exterior. This makes it difficult for the reactive neutral particles and the gas molecules to reach the inlet of the collision cell 11, thereby the amount of the reactive neutral particles and the gas molecules which enter the collision cell 11 is reduced.

As previously mentioned, the voltage applied to the inlet electrode 12 of the collision cell 11 causes an electric field having a polarity the same as that of ions originating from the plasma gas or other gases, to be formed in the region 32 between the ion lens 10 and the inlet electrode 12. Accordingly, ions which have been introduced into the second vacuum chamber 3 through the first vacuum chamber 2 from the ICP ion source 5 and have passed the aforementioned region 31 are pushed back in front of the inlet electrode 12. Thus, the entering of the undesired ions originating from the plasma gas or other gases into the collision cell 11 can be further reduced. Here, the reactive neutral particles and molecules do not have an electrical charge, and thus these cannot be removed by the effect of the electric field formed in the region 32. However, it is difficult for the reactive neutral particles and molecules to pass through the region 31, as mentioned earlier. Therefore, the amount of the reactive neutral particles or the gas molecules entering the collision cell 11 is low.

A part of the ions originating from the plasma gas or other gases may enter the collision cell 11 through each of the region 31 and the region 32. Furthermore, a part of the reactive neutral particles or the molecules originating from the plasma gas or other gases may enter the collision cell 11 through the region 31 and the region 32, and come in contact with the gas in the collision cell 11, so as to become undesired ions. Such ions coming from the exterior and ions generated in the collision cell 11 come in contact with the gas existing in the collision cell 11 to thereby reduce their energy, and are trapped by the radio-frequency electric field formed by the ion guide 14. The radio-frequency electric field at this time is stronger than that of the usual analysis. Thus, ions are converged by a relatively narrow region 33 in the vicinity of the ion optical axis 18.

As mentioned earlier, the relatively high voltage with the polarity opposite to that of ions to be trapped is applied to the outlet electrode 13 of the collision cell 11. Accordingly, the ions that stay in the region 33 are attracted by the strong electric field formed by the voltage applied to the outlet electrode 13, and ejected from the collision cell 11 through the ion passing opening 131 of the outlet electrode 13.

In other words, during the analysis preparation period of time before the analysis, the undesired ions and undesired reactive neutral particles are prevented from entering the collision cell 11, between the ICP ion source 5 and the collision cell 11. Meanwhile, undesired ions incident in the collision cell 11 and undesired ions generated in the collision cell 11 are quickly ejected to the outside of the collision cell 11. As such, in the ICP-MS according to the present embodiment, it is difficult for ions to stay in the collision cell 11 during the analysis preparation term.

The controller 22 waits until the predetermined waiting time period elapses, which has been previously fixed so that the collision cell 11 is sufficiently filled with the gas supplied from the gas supplier 19 (Step 107). The gas introduced in the collision cell 11 leaks from ion passing openings 121 and 131 respectively in the inlet electrode 12 and the outlet electrode 13. Thus, it is preferable for waiting a long period of time for allowing the collision cell 11 to be filled with gas molecules at the density as uniform as possible. As an example, it is preferable that the waiting time period from the start of the gas introduction be 40 seconds or more.

After the predetermined waiting time period elapses (Yes in Step 107), the voltage controller 21 that has received the command from the controller 22 controls the voltage generator 20 to apply the negative direct-current voltage with the predetermined voltage value at which the ions are attracted, to the attraction electrode 9 (Step 108). The voltage controller 21 also controls the voltage generator 20 to apply the negative direct-current voltage with the predetermined voltage value to the inlet electrode 12 of the collision cell 11 (Step 109). In addition, the voltage controller 21 controls the voltage generator 20 to apply a radio-frequency voltage with the predetermined amplitude value depending on a component to be analyzed (target component), to the ion guide 14 in the collision cell 11 (Step 110). The voltage controller 21 also controls the voltage generator 20 to apply the predetermined voltage for forming the potential barrier, to the outlet electrode 13 of the collision cell 11 (Step 111).

Then, the analysis is performed in the state where the voltage is applied to each of the sections, as in Steps 108 to 111 (Step 112). In other words, the voltage controller 21 sets the voltage to be applied to the quadrupole mass filter 16 so that the ions originating from the target component to pass, for example. After the lapse of the time period required for the voltage applied to each of the sections to be statically determined (for example, a level of several msec), the intensity of ions of the target sample component is detected.

For example, in the collision mode, ions that are originating from a sample component are generated in the ICP ion source 5, and are introduced in the collision cell 11 filled with the collision gas, with the undesired ions originating from the plasma gas. The introduced ions repeatedly collide with the collision gas, and thus their energy is attenuated. Ions with a larger collision cross-section have more opportunities to collide with the collision gas, thereby causing their energy to greatly attenuate. Usually, a collision cross-section of an ion originating from the plasma gas is larger than a collision cross-section of an ion originating from the target sample component. Accordingly, the ions originating from the plasma gas have smaller kinetic energy. Accordingly, it is difficult for the ions originating from the plasma gas to overcome the potential barrier formed at the ejection port of the collision cell 11. Thus, unnecessary ions originating from the plasma gas or other gases are removed by the kinetic energy discrimination method, so that ions of the sample component are mainly sent to the quadrupole mass filter 16 for the analysis.

As mentioned earlier, almost no ion exists in the collision cell 11 during the analysis preparation period of time before the start of the analysis. Accordingly, there is practically no space charge effect of the ions that stay in the collision cell 11 at the start of the analysis on the ions originating from the sample component. Thus, the trajectories of ions originating from the sample component introduced in the collision cell 11 do not receive any space charge effect during the analysis, and the ions that pass through the collision cell 11 along the normal trajectories are introduced in the quadrupole mass filter 16. This increases the amount of ions that originate from the sample component and finally reach the ion detector 17, in comparison with a conventional configuration, thereby achieving the high analysis sensitivity. Furthermore, the trajectories of ions originating from the sample component are not affected by the space charge effect, thereby reducing the drift in the ion intensity, and further reducing the variation in the drift, caused by the type of sample components.

In the previous description, the voltage to be applied to each of the sections is set so that ions do not stay in the collision cell 11, over the entirety of the analysis preparation period of time from the start of the gas supply into the collision cell 11 until the collision cell 11 is sufficiently filled with the gas and the analysis starts. However, it is not necessary to perform such voltage setting continuously over the entirety of the analysis preparation term. For example, in the flowchart shown in FIG. 3, the processing in Steps 103 to 106 may be conducted after the predetermined time period elapses from the start of the gas supply in Step 102. In addition, the basic operations in the reaction mode are the same as those in the collision mode.

<Example in Apparatus According to Present Embodiment>

Figure 4:
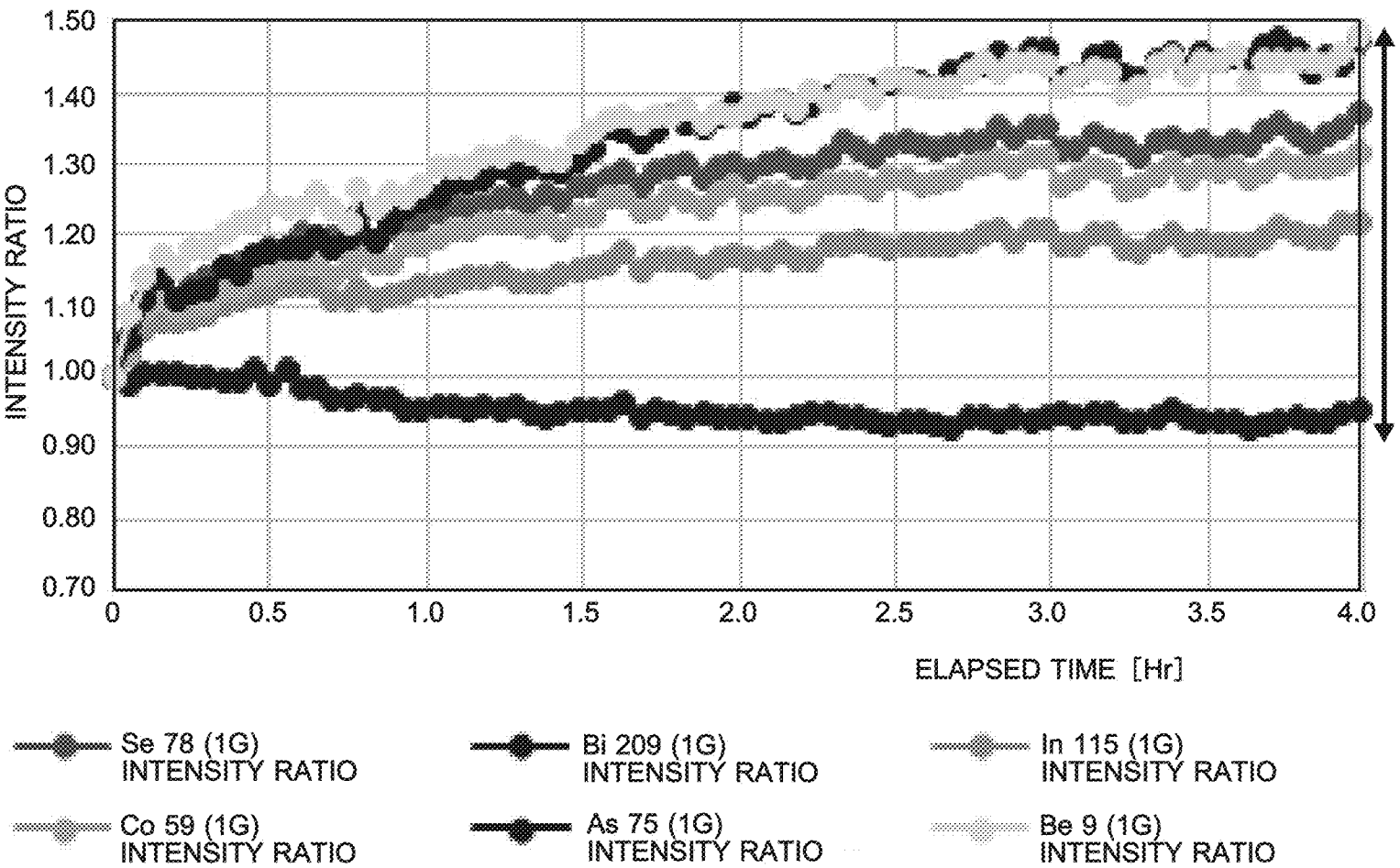
FIG. 4 is a graph showing the results of actual measurement of temporal change in the ion intensity.
Figure 5:
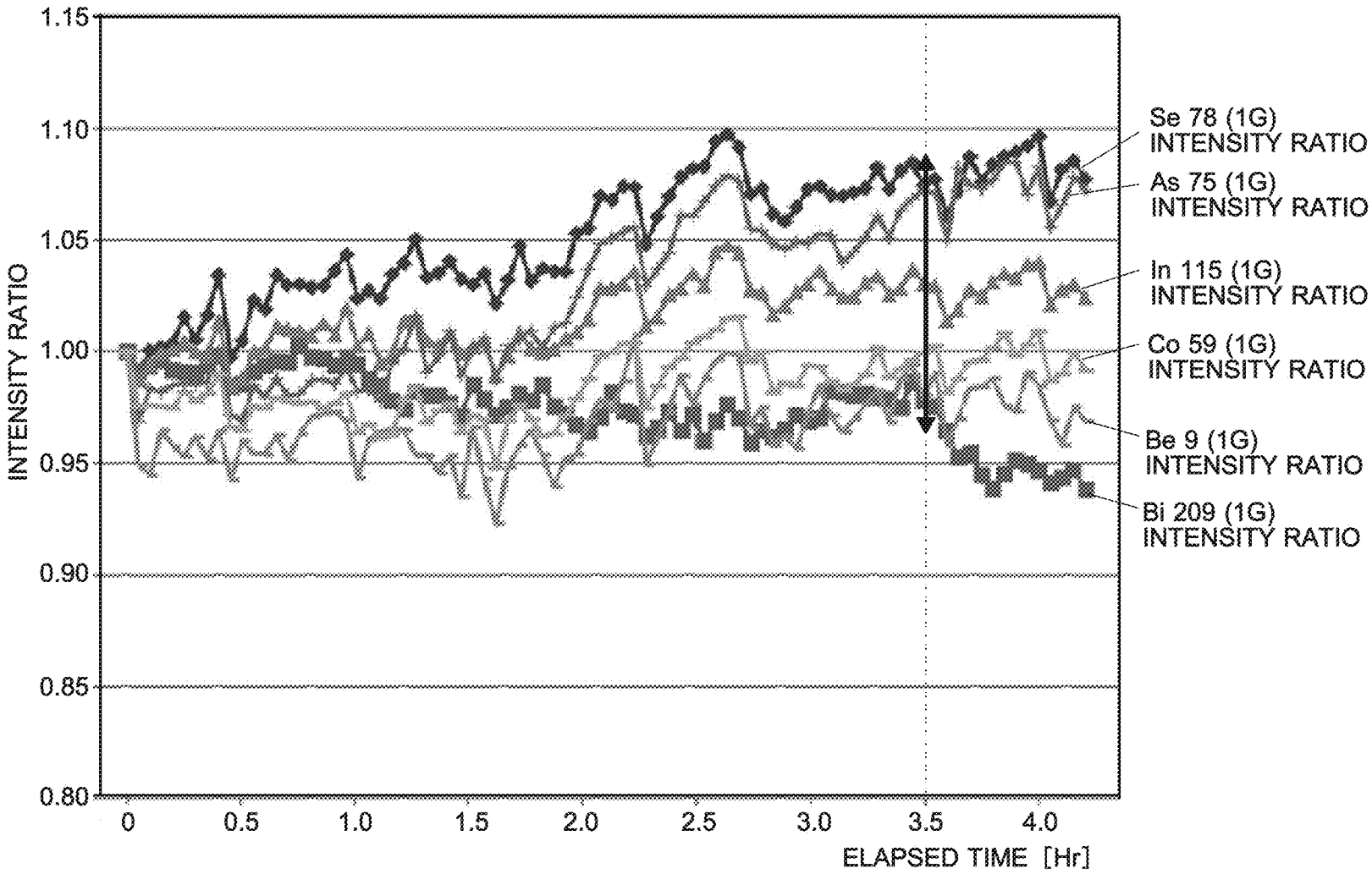
FIG. 5 is a graph showing the results of actual measurement of temporal change in the ion intensity.
Figure 6:
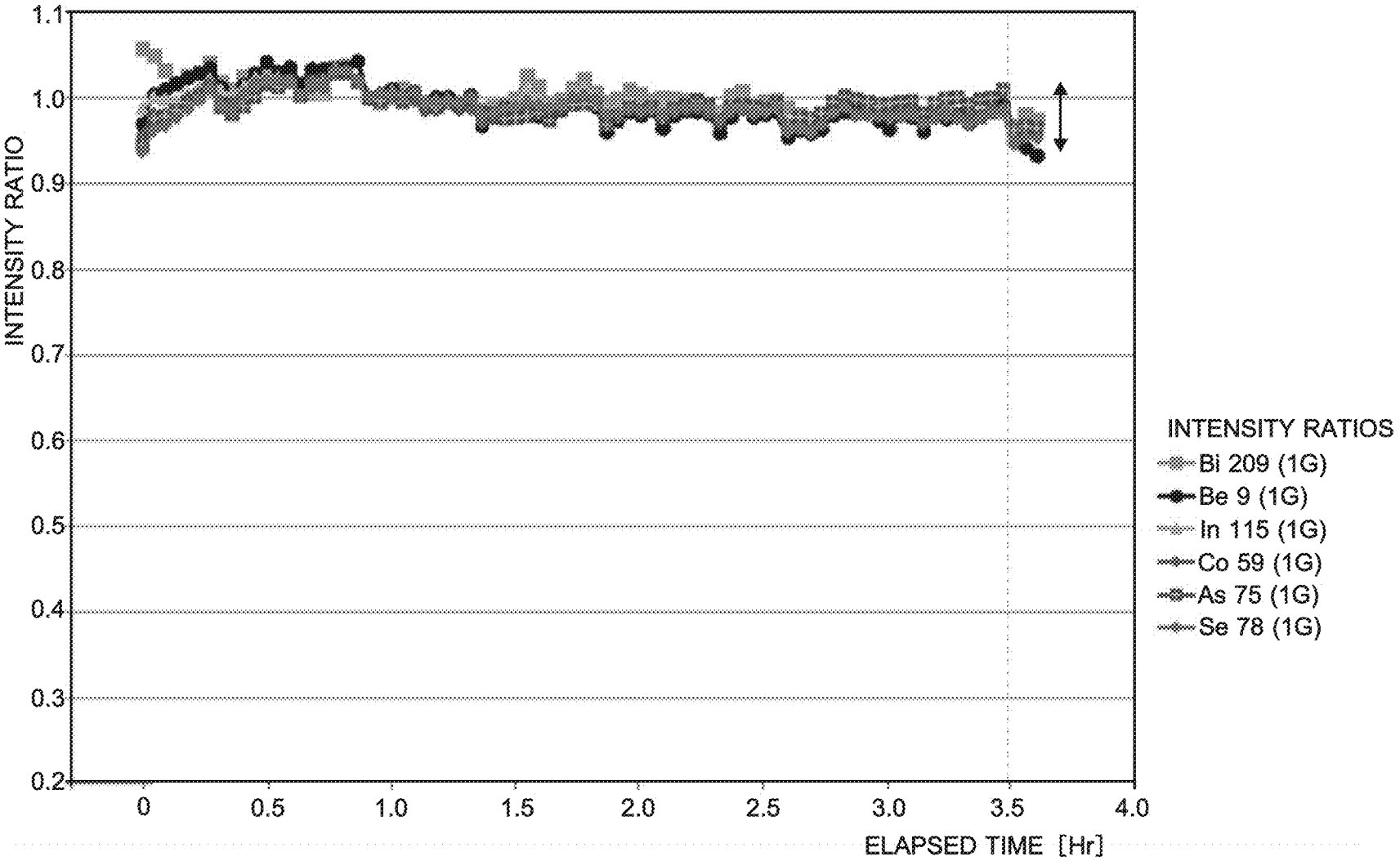
FIG. 6 is a graph showing the results of actual measurement of temporal change in the ion intensity.

FIGS. 4 to 6 are a graph showing the measurement results of temporal change in the ion intensity in the ICP-MS according to the present embodiment. These are the results of the actual measurement in the reaction mode using the $H_2$ gas as the reaction gas. The measurement was performed for the temporal change in the ion intensity by repeating the selected ion monitoring (SIM) measurement, in terms of six elements including selenium (Se), bismuth (Bi), indium (In), cobalt (Co), arsenicum (As), and beryllium (Be). In each drawing, the elapsed time is indicated in the horizontal axis, and the intensity ratio of the ion is indicated in the vertical axis.

FIG. 4 shows the measurement result obtained in the case where none of the three countermeasures of: blocking the passing of ions and neutral particles in the region 31; blocking the passing of ions in the region 32; and promoting the ejection of ions from the region 33, was not performed (i.e., the same as the conventional configuration). FIG. 5 shows the measurement result obtained in the case where only two the countermeasures, i.e., blocking the passing of ions in the region 32 and promoting the ejection of ions from the region 33 were performed. FIG. 6 shows the measurement result obtained in the case where all of the three aforementioned countermeasures were performed. In the drawings, the maximum width of the variety in the ion intensity in terms of the six elements after 3.5 hours passed is shown by the vertical arrow indicating both directions.

FIGS. 4 to 6 show that the stability in the ion intensity is remarkably improved for an extended period of time by the two countermeasures of blocking the passing of ions in the region 32 and promoting the ejection of ions from the region 33. In addition, these drawings also show that the stability in the ion intensity for an extended period of time is further improved by adding the remaining countermeasure of blocking the passing ions and neutral particles in the region 31. Although the ICP-MS according to the present embodiment adopt all of the three countermeasures, it becomes clear, from the results, that all of the three countermeasures are not necessarily adopted. The aforementioned effect can be obtained by adopting at least one of the three countermeasures. If only one of the countermeasures, e.g., the blockage of the passing ions and neutral particles in the region 31, is adopted, the aforementioned effect can be obtained. If two of the countermeasures, e.g., the blockage of the passing of ions in the region 32 and the promotion of the ejection of ions from the region 33 are adopted, the aforementioned effect can also be obtained.

MODIFIED EXAMPLE

The IPC-MS according to the aforementioned embodiment is a so-called single quadrupole mass spectrometer. Here, the configuration of a mass spectrometer unit can be appropriately changed. Examples of the mass spectrometer including such a modified mass spectrometer unit includes a triple quadrupole mass spectrometer provided with the IPC ion source, a quadrupole time-of-flight (Q-TOF) mass spectrometer provided with the IPC ion source, and so on.

Each of the structural elements in the ICP-MS according to the aforementioned embodiment can be replaced with known structural elements having the same function. For example, although the ion guide 14 located in the collision cell 11 includes a multipole rod electrode, the ion guide 14 can be replaced with others that have the function of converging ions by the radio-frequency electric field.

The present invention can also be applied to a mass spectrometer having an ion source that is not the ICP ion source. Specifically, it is particularly effective for the present invention to be applied to a mass spectrometer having: an ion source using Ar gas or other gases from which undesired ions are easily generated at the ionization; and a collision cell for allowing ions generated in the ion source or ions originating from the ions generated in the ion source to be in contact with the gas to reduce the energy of ions or induce dissociation of the ions. Here, the ion source includes an electrospray ionization (ESI) ion source, an atmospheric pressure chemical ionization (APCI) ion source, a probe electrospray ionization ion source, a direct analysis in real time (DART) ion source, and such ion sources by various ionization methods.

The aforementioned embodiment and the modified example are included in the present invention as an example. It is apparent that any modification, change, or addition within the scope of the present invention is included in the scope of claims of the present application.

<Description of Various Embodiments of the Present Invention>

Various embodiments according to the present invention have been described heretofore, with reference to the drawings. Subsequently, various aspects of the present invention are described in closing.

A mass spectrometer according to the first aspect of the present invention is the mass spectrometer including an ion source (5) for ionizing a sample component; a cell (11) into which a predetermined gas is introduced, and allows an ion generated in the ion source (5) or an ion originating from the ion generated in the ion source (5) to be in contact with the predetermined gas; and a mass spectrometer unit (16) that performs mass spectrometry on the ion ejected from the cell (11) or an ion originating from the ion ejected from the cell (11). The mass spectrometer further includes:

an inlet electrode (12) provided at an ion injection port through which the ion is incident in the cell (11);

a voltage generator (20) for applying a direct-current voltage to the inlet electrode (12); and a controller (21, 22) for controlling the voltage generator (20) to apply, to the inlet electrode (12), the direct-current voltage with a polarity same as a polarity of an elimination-target ion generated in the ion source (5), during at least a part of a standby period of time in which no analysis-target ion is analyzed.

A mass spectrometer according to the second aspect of the present invention is the mass spectrometer including: an ion source (5) for ionizing a sample component; a cell (11) into which a predetermined gas is introduced, and configured to an ion generated in the ion source (5) or an ion originating from the ion generated in the ion source (5) to be in contact with the predetermined gas; and a mass spectrometer unit (16) that performs mass spectrometry on the ion ejected from the cell (11) or an ion originating from the ion ejected from the cell (11). The mass spectrometer further includes:

a skimmer (8) that is provided between the ion source (5) and the cell (11), and has, at its top, an ion passing port (801);

an attraction electrode (9) that is provided between the skimmer (8) and the cell (11), and promotes the attraction of the ion through the ion passing port (801) of the skimmer (8), using an effect of an electric field;

a voltage generator (20) for applying a direct-current voltage to the attraction electrode (9); and a controller (21, 22) for controlling the voltage generator (20) to apply, to the attraction electrode (9), a direct-current voltage with a polarity the same as the polarity of an elimination-target ion generated in the ion source (5), or a direct-current voltage having no effect in attracting the elimination-target ion, during at least a part of a standby period of time in which no analysis-target ion is analyzed.

According to the first aspect of the mass spectrometer, it becomes difficult for unnecessary ions generated in the ion source during the standby period of time to enter the cell. Accordingly, the space charge effect caused by the unnecessary ions accumulated in the cell is reduced or practically prevented, when the analysis-target ion is analyzed. This reduces or eliminates the effect by the space charge effect on the analysis-target ion in the cell, thereby preventing the temporal variation, i.e., drift, of the ion intensity, so as to enable the analysis with high accuracy.

According to the second aspect of the mass spectrometer, it becomes difficult for unnecessary ions generated in the ion source during the standby period of time to enter the cell. Along with this, it is also difficult for undesired particles with no electric charge, such as reactive neutral particles generated in the ion source, to enter the cell, due to a disturbance by the ions staying in the space between the skimmer and the attraction electrode. Accordingly, the space charge effect caused by the accumulation of the unnecessary ions in the cell is reduced or practically prevented, when the analysis-target ion is analyzed. This reduces or eliminates the effect by the space charge effect on the analysis-target ion in the cell, thereby preventing the temporal variation, i.e., drift, of the ion intensity, so as to enable the analysis with high accuracy.

A mass spectrometer according to the third aspect is the mass spectrometer according to the first aspect, which further includes an outlet electrode (13) provided at an ion ejection port through which the ion is ejected from the cell (11). In such a mass spectrometer, the voltage generator (20) applies the direct-current voltage to the outlet electrode (13), separately from the inlet electrode (12), and the controller (21, 22) controls the voltage generator (20) to apply, to the outlet electrode (13), the direct-current voltage with a polarity opposite to the polarity of the elimination-target ion, during at least a part of the standby period of time in which no analysis-target ion is analyzed.

In the mass spectrometer according to the third aspect, unnecessary ions incident in the cell without being blocked in front of the cell, and unnecessary ions generated from the reactive neutral particles in the cell can be quickly ejected from the cell to the outside. Accordingly, the unnecessary ions existing in the cell can be further reduced when the analysis-target ion is analyzed. This assuredly reduces the influence by the space charge effect on the analysis-target ion in the cell, thereby enhancing the temporal stability in the ion intensity, so as to enable the analysis with high accuracy.

A mass spectrometer according to the fourth aspect is the mass spectrometer according to the third aspect, which further includes an ion guide (14) that is provided in the cell (11), and traps the ion using a radio-frequency electric field. In the mass spectrometer, the voltage generator (20) applies a radio-frequency voltage to the ion guide (14), separately from the inlet electrode (12) and the outlet electrode (13), and the controller (21, 22) controls the voltage generator (20) to apply, to the ion guide (14), the radio-frequency voltage for trapping the ion, when the direct-current voltage with the polarity opposite to the polarity of the elimination-target ion is applied to the outlet electrode (13).

In the mass spectrometer according to the fourth aspect, unnecessary ions incident in the cell and unnecessary ions generated in the cell are trapped due to the radio-frequency electric field by the ion guide, and aggregate around the ion optical axis. Accordingly, when the direct-current voltage with the polarity opposite to the polarity of the unnecessary ions is applied to the outlet electrode, the unnecessary ions are easily ejected to the outside by the electric field formed by the applied direct-current voltage. As a result, the unnecessary ions can be efficiently and assuredly ejected from the cell.

A mass spectrometer according to the fifth aspect is the mass spectrometer according to any one of the first, third, and fourth aspects, which further includes:

a skimmer (8) that is provided between the ion source (5) and the cell (11), and has, at its top, an ion passing port (801); and an attraction electrode (9) that is provided between the skimmer (8) and the cell (11), and promotes the attraction of the ion through the ion passing port (801) of the skimmer (8), using an effect of the electric field. In such a mass spectrometer, the voltage generator (20) applies the direct-current voltage to the attraction electrode (9), separately from the inlet electrode (12), and the controller (21, 22) controls the voltage generator (20) to apply, to the attraction electrode (9), a direct-current voltage having no effect in attracting the ion, during at least a part of the standby period of time in which no analysis target ion is analyzed.

In the mass spectrometer according to the fifth aspect, it is difficult for unnecessary ions generated in the ion source to enter the cell during the standby term. In addition, it is also difficult for undesired particles having no electric charge, such as the reactive neutral particles generated in the ion source, to enter the cell, due to a disturbance by ions staying in the space between the skimmer and the attraction electrode. Accordingly, the space charge effect caused by the accumulation of the unnecessary ions in the cell is reduced or practically prevented, when the analysis-target ion is analyzed. This further reduces the effect of the space charge effect on the analysis-target ion in the cell, thereby further enhancing the stability of the ion intensity.

A mass spectrometer according to the sixth aspect is the mass spectrometer according to any one of the first to fifth aspects, in which the standby period of time where no analysis-target ion is analyzed corresponds to a period of time from a time point where introduction of the predetermined gas into the cell (11) is started to a time point where the cell (11) is sufficiently filled with the predetermined gas.

In the mass spectrometer according to the sixth aspect of the present invention, unnecessary ions remaining in the cell can be removed during the period of time in which the cell is filled with the gas necessary for the analysis. With this configuration, immediately after the cell is filled with the gas, the target sample component can be analyzed, thereby improving the throughput of the analysis.

A mass spectrometer according to the seventh aspect is the mass spectrometer according to any one of the first to seventh aspects, in which the ion source (5) is an inductively coupled plasma ion source, the cell (11) is a collision cell for removing an interference ion, and the elimination-target ion is an ion originating from a plasma gas used in the ion source (5).

In the mass spectrometer according to the seventh aspect of the present invention, an adverse effect due to the accumulation of the ions originating from the plasma gas or Ar generated in the ICP ion source is eliminated, to enable the analysis of the ions originating from the target sample component with high accuracy.

REFERENCE SIGNS LIST

1 . . . Ionization Chamber
2 . . . First Vacuum Chamber
3 . . . Second Vacuum Chamber
4 . . . Third Vacuum Chamber
10 . . . Ion Lens
11 . . . Collision Cell
12 . . . Inlet Electrode
121, 131 . . . Ion Passing Opening
13 . . . Outlet Electrode
14 . . . Ion Guide
15 . . . Electrode for Forming Energy Barrier
16 . . . Quadrupole Mass Filter
17 . . . Ion Detector
18 . . . Ion Optical Axis
19 . . . Gas Supplier
20 . . . Voltage Generator
21 . . . Voltage Controller
22 . . . Controller
23 . . . Input Unit
24 . . . Display Unit
25 . . . Data Processor
5 . . . ICP Ion Source
51 . . . Plasma Torch
52 . . . Autosampler
7 . . . Sampling Cone
801 . . . Ion Passing Port
8 . . . Skimmer
9 . . . Attraction Electrode

The invention claimed is:

1. A mass spectrometer including: an ion source configured to ionize a sample component; a cell into which a predetermined gas is introduced, the cell being configured to allow an ion generated in the ion source or an ion originating from the ion generated in the ion source to be in contact with the predetermined gas; and a mass spectrometer unit configured to perform mass spectrometry on an ion ejected from the cell or an ion originating from the ion ejected from the cell, the mass spectrometer comprising:

an inlet electrode provided at an ion injection port through which the ion generated in the ion source or the ion originating from the ion generated in the ion source is incident in the cell;

a voltage generator configured to apply a direct-current voltage to the inlet electrode; and a controller configured to control the voltage generator to apply, to the inlet electrode, the direct-current voltage with a polarity same as a polarity of an elimination-target ion generated in the ion source, during at least a part of a standby period of time in which no analysis-target ion is analyzed, wherein the standby period of time in which no analysis-target ion is analyzed corresponds to a period of time from a time point where introduction of the predetermined gas into the cell is started to a time point where the cell is filled with the predetermined gas.

2. The mass spectrometer according to claim 1, further comprising an outlet electrode provided at an ion ejection port through which the ion is ejected from the cell, wherein the voltage generator is also configured to apply the direct-current voltage to the outlet electrode, separately from the inlet electrode, and the controller is also configured to control the voltage generator to apply, to the outlet electrode, the direct-current voltage with a polarity opposite to the polarity of the elimination-target ion, during at least a part of the standby period of time in which no analysis-target ion is analyzed.

3. The mass spectrometer according to claim 2, further comprising an ion guide provided in the cell, the ion guide being configured to trap the ion using a radio-frequency electric field, wherein the voltage generator is also configured to apply a radio-frequency voltage to the ion guide, separately from the inlet electrode and the outlet electrode, and the controller is also configured to control the voltage generator to apply, to the ion guide, the radio-frequency voltage for trapping the ion, when the direct-current voltage with the polarity opposite to the polarity of the elimination-target ion is applied to the outlet electrode.

4. The mass spectrometer according to claim 1, further comprising:

a skimmer provided between the ion source and the cell, the skimmer having, at its top, an ion passing port; and an attraction electrode provided between the skimmer and the cell, the attraction electrode being configured to promote attraction of the ion through the ion passing port of the skimmer, using an effect of the electric field, wherein the voltage generator is also configured to apply the direct-current voltage to the attraction electrode, separately from the inlet electrode, and the controller is also configured to control the voltage generator to apply, to the attraction electrode, the direct-current voltage having no effect in attracting the ion, during at least a part of the standby period of time in which no analysis target ion is analyzed.

5. The mass spectrometer according to claim 1, wherein the ion source is an inductively coupled plasma ion source, the cell is a collision cell for removing an interference ion, and the elimination-target ion is an ion originating from a plasma gas used in the ion source.

6. A mass spectrometer including: an ion source configured to ionize a sample component; a cell into which a predetermined gas is introduced, the cell being configured to allow an ion generated in the ion source and an ion originating from the ion generated in the ion source to be in contact with the predetermined gas; and a mass spectrometer unit configured to perform mass spectrometry on an ion ejected from the cell or an ion originating from the ion ejected from the cell, the mass spectrometer comprising:

a skimmer provided between the ion source and the cell, the skimmer having, at its top, an ion passing port;

an attraction electrode provided between the skimmer and the cell, the attraction electrode being configured to promote attraction of the ion generated in the ion source or the ion originating from the ion generated in the ion source through the ion passing port of the skimmer, using an effect of an electric field during a time period other than a standby period of time in which no analysis-target ion is analyzed;

a voltage generator configured to apply a direct-current voltage to the attraction electrode; and a controller configured to control the voltage generator to apply, to the attraction electrode, a direct-current voltage with a polarity same as a polarity of an elimination-target ion generated in the ion source, or a direct-current voltage having no effect in attracting the elimination-target ion, during at least a part of the standby period of time in which no analysis-target ion is analyzed, wherein the polarity of an elimination-target ion is same as a polarity of the ion generated in the ion source or the ion originating from the ion generated in the ion source;

wherein the standby period of time in which no analysis-target ion is analyzed corresponds to a time period from a time point where introduction of the predetermined gas into the cell is started to a time point where the cell is filled with the predetermined gas.

7. The mass spectrometer according to claim 6, wherein the ion source is an inductively coupled plasma ion source, the cell is a collision cell for removing an interference ion, the elimination-target ion is an ion originating from a plasma gas used in the ion source.

8. A mass spectrometer including: an ion source configured to ionize a sample component; a cell into which a predetermined gas is introduced, the cell being configured to allow an ion generated in the ion source and an ion originating from the ion generated in the ion source to be in contact with the predetermined gas; and a mass spectrometer unit configured to perform mass spectrometry on an ion ejected from the cell or an ion originating from the ion ejected from the cell, the mass spectrometer comprising:

a skimmer provided between the ion source and the cell, the skimmer having, at its top, an ion passing port;

an attraction electrode provided between the skimmer and the cell, the attraction electrode being configured to promote attraction of the ion generated in the ion source or the ion originating from the ion generated in the ion source through the ion passing port of the skimmer, using an effect of an electric field during a time period other than a standby period of time in which no analysis-target ion is analyzed;

a voltage generator configured to apply a direct-current voltage to the attraction electrode; and a controller configured to control the voltage generator to apply, to the attraction electrode, a direct-current voltage with a polarity same as a polarity of an elimination-target ion generated in the ion source, or a direct-current voltage having no effect in attracting the elimination-target ion, during at least a part of the standby period of time in which no analysis-target ion is analyzed, wherein the polarity of an elimination-target ion is same as a polarity of the ion generated in the ion source or the ion originating from the ion generated in the ion source, and the ion source is an inductively coupled plasma ion source, the cell is a collision cell for removing an interference ion, the elimination-target ion is an ion originating from a plasma gas used in the ion source.

* * * * *